US005862898A

United States Patent [19]

Chang

[11] Patent Number: 5,862,898

[45] Date of Patent: Jan. 26, 1999

[54] RETRACTABLE HANDLE MOUNTING STRUCTURE

[76] Inventor: Fu-Cheng Chang, P.O. Box 82-144, Taipei, Taiwan

[21] Appl. No.: 823,126

[22] Filed: Mar. 25, 1997

[51] Int. Cl.[6] ..... A45C 5/14; A45C 13/26

[52] U.S. Cl. ..... 190/115; 16/115; 190/18 A; 190/39

[58] Field of Search ..... 16/1, 5; 190/115–118, 190/39, 18 A

[56] References Cited

U.S. PATENT DOCUMENTS

| | | | |
|---|---|---|---|
| 5,438,731 | 8/1995 | Kazmark, Jr. | 16/115 |
| 5,459,908 | 10/1995 | Chen | 16/115 |
| 5,513,873 | 5/1996 | Cheng | 16/115 X |
| 5,581,846 | 12/1996 | Wang | 16/115 |
| 5,584,097 | 12/1996 | Lu | 16/115 |
| 5,620,070 | 4/1997 | Wang | 190/39 X |
| 5,630,250 | 5/1997 | Chou | 190/115 X |
| 5,630,488 | 5/1997 | Cheng | 190/115 |
| 5,636,410 | 6/1997 | Chou | 16/115 |
| 5,639,109 | 6/1997 | Liang | 190/18 A X |

*Primary Examiner*—Sue A. Weaver
*Attorney, Agent, or Firm*—A & J

[57] ABSTRACT

A retractable handle mounting structure includes two inner bars joined by a hand grip and moved with two sliding tracks in and out of two sleeves between a top frame and a wheeled bottom frame, two control blocks forced by a respective spring to lock the inner bars, and a control bar mounted in a hole at one end of the hand grip and supported on a spring at the bottom of one inner bar and depressed to force one control block out of engagement with the corresponding inner bar, and a linkage coupled between the control blocks, the linkage being actuated to pull both control blocks out of engagement with the inner bars upon depress of the control bar.

1 Claim, 6 Drawing Sheets

RETRACTABLE HANDLE MOUNTING STRUCTURE

BACKGROUND OF THE INVENTION

1. Field of the Invention

This invention relates to a retractable handle mounting structure for a luggage carrier, and more particularly to such a retractable handle mounting structure which permits the user to operate the retractable handle with one hand.

2. Description of the Prior Art

There is known a retractable handle mounting arrangement, which was invented by the present inventor, comprised of a top frame, a bottom frame, a retractable handle connected between the top frame and the bottom frame, and a press control device mounted in the top frame and forced by spring means to lock the inner bars of the retractable handle, the press control device comprising two control blocks forced by spring means into engagement with the inner bars of the retractable handle, and a spring-supported press block adapted for pressing by hand to pull the control blocks inwards, causing them to release the inner bars of the retractable handle, for permitting the retractable handle to be extended out. This design of retractable handle mounting arrangement is functional, however it is not convenient to operate the retractable handle because the user must pull or push the retractable handle with one hand and press the press block with the other hand. Therefore, one shall have to keep the both hands free before operating the retractable handle.

SUMMARY OF THE INVENTION

This invention relates to a retractable handle mounting structure for a luggage carrier, and more particularly to such a retractable handle mounting structure which permits the user to operate the retractable handle with one hand.

To achieve this and other objects of the present invention, there is provided a retractable handle mounting structure which comprises two inner bars joined by a hand grip and moved with two sliding tracks in and out of two sleeves between a top frame and a wheeled bottom frame, two control blocks forced by a respective spring to lock the inner bars, and a control bar mounted in a hole at one end of the hand grip and supported on a spring at the bottom of one inner bar and depressed to force one control block out of engagement with the corresponding inner bar, and a linkage coupled between the control blocks, the linkage being actuated to pull both control blocks out of engagement with the inner bars upon depress of the control bar.

DETAILED DESCRIPTION OF THE PREFERRED EMBODIMENT

Figure 1:
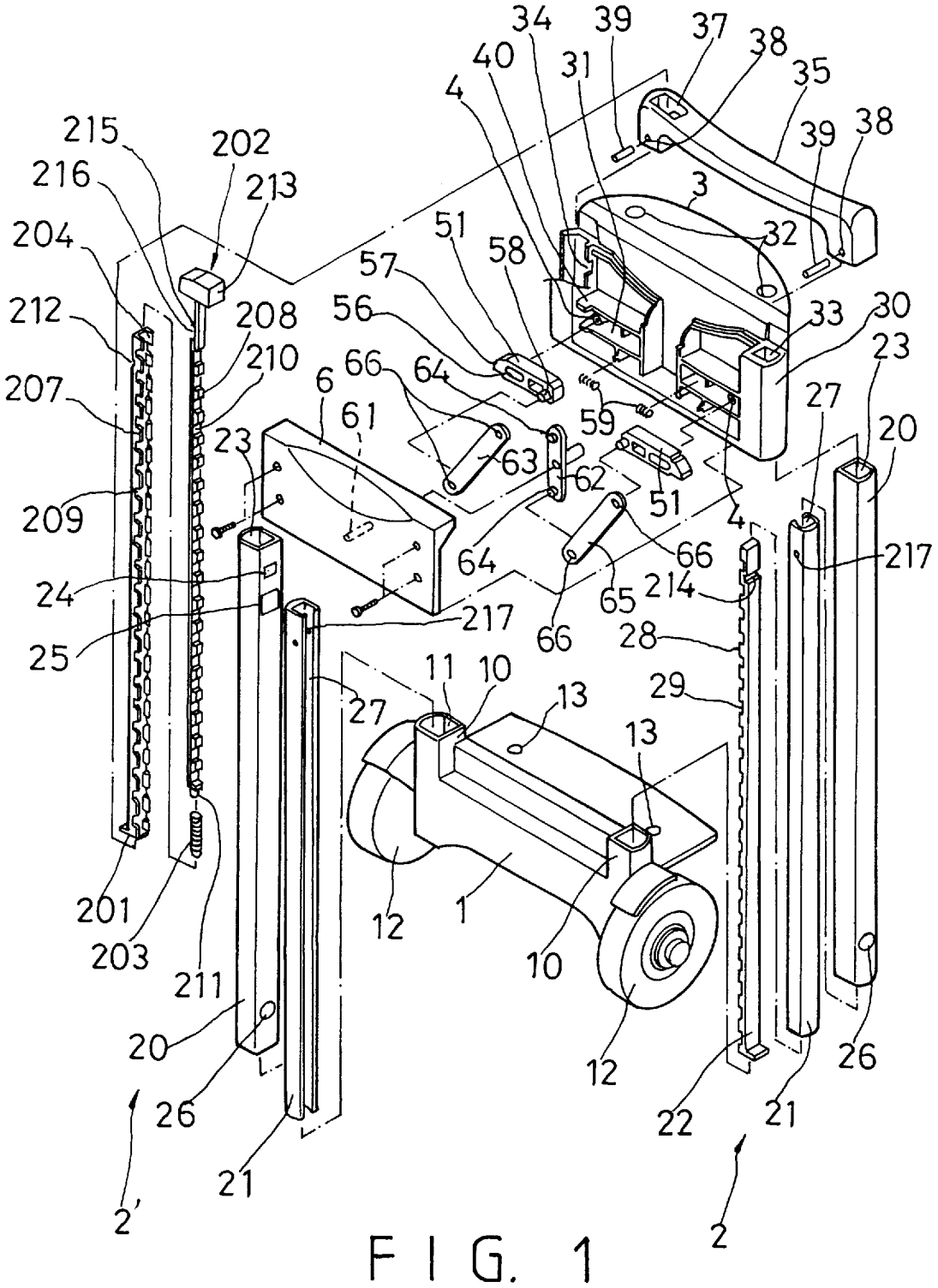
FIG. 1 is an exploded view of a retractable handle mounting structure according to the present invention.
Figure 2:
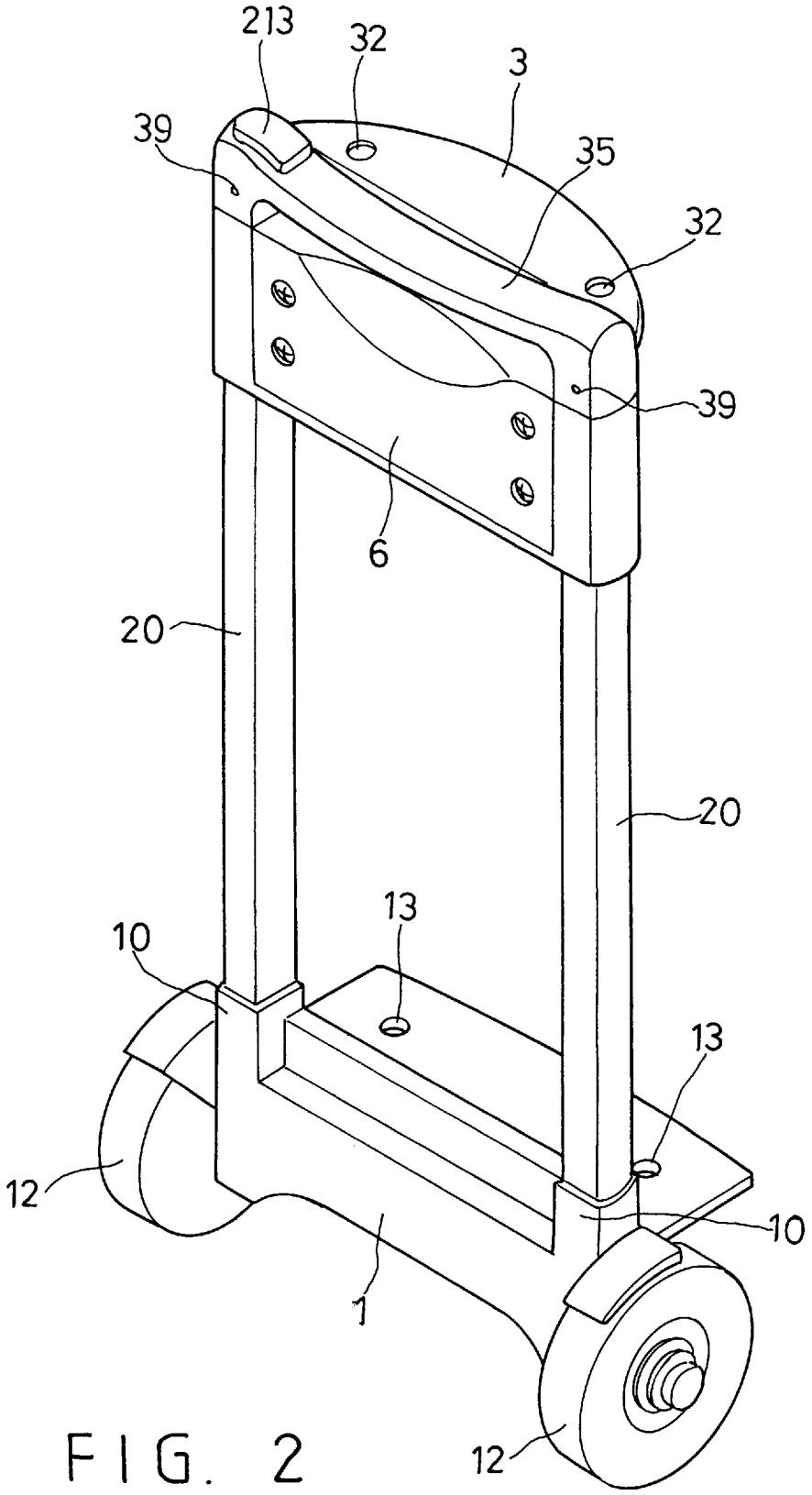
FIG. 2 is an elevational view of the present invention, showing the retractable handle mounting structure assembled.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, a retractable handle mounting structure in accordance with the present invention comprises a base frame 1, two bars 2 and 2', a top frame 3, two control blocks 51, and a cover 6.

The base frame 1 is equipped with a pair of wheels 12, having a plurality of mounting holes 13 adapted for fastening to the bottom panel of for example a travel bag by screws, and two short upright posts 10 raised from the top at two opposite sides and defining a respective top coupling hole 11.

Figure 3:
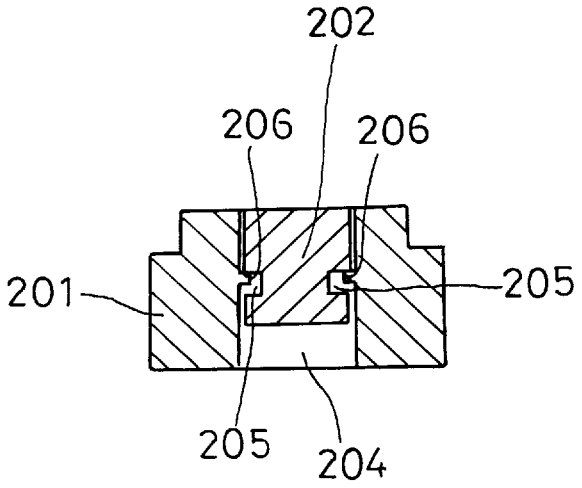
FIG. 3 is a sectional view of a part of the present invention, showing the engagement between the inner bar and the control bar.
Figure 4:
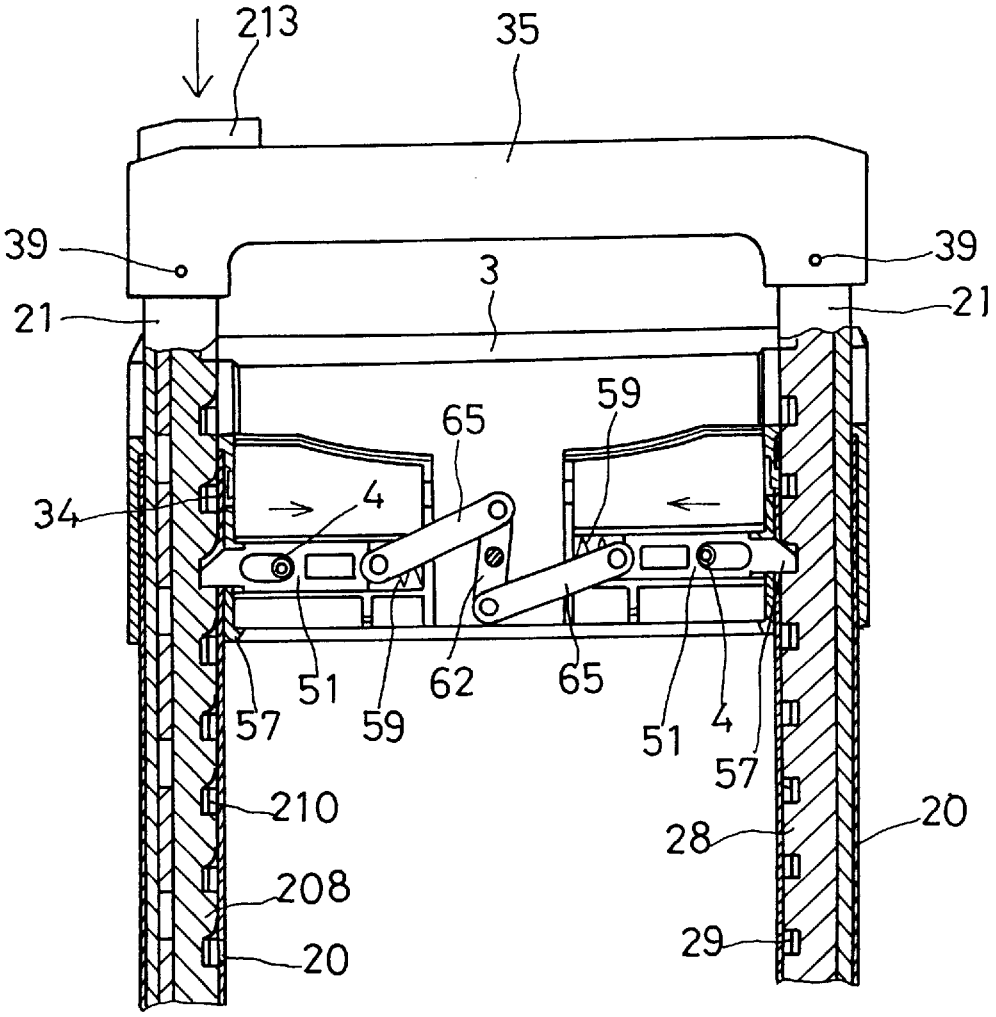
FIG. 4 is a sectional view of the upper part of the present invention, showing the press block of the control bar depressed and the control blocks disengaged from the inner bars.
Figure 5:
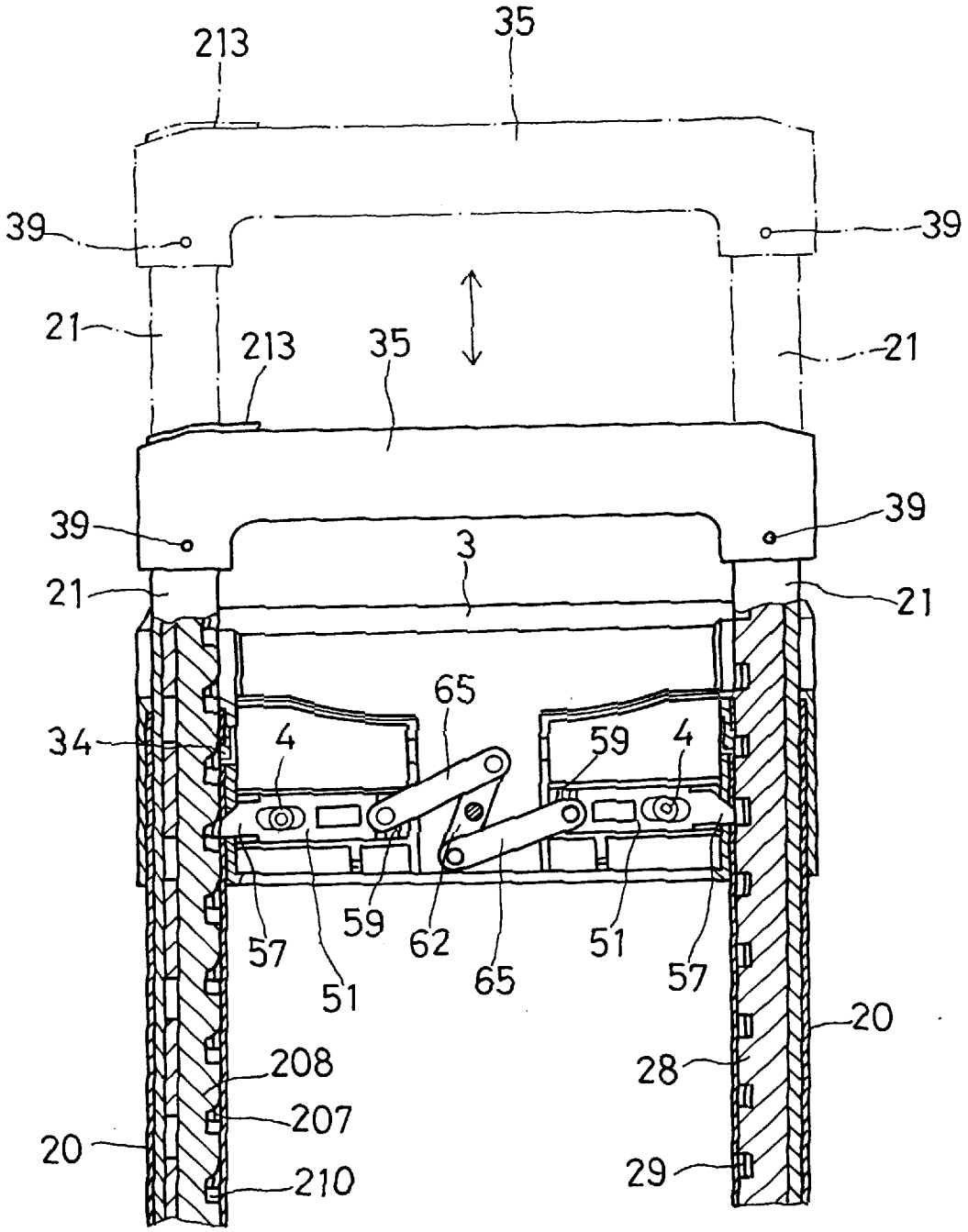
FIG. 5 is another sectional view of the upper part of the present invention, showing the control blocks disengaged from the inner bars, the hand grip pulled.
Figure 6A:
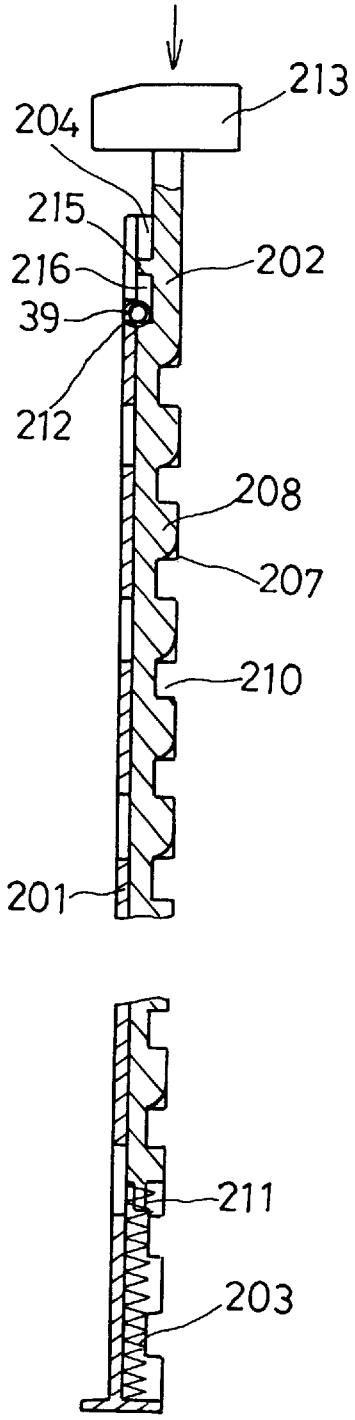
FIG. 6A is a sectional view of a part of the present invention, showing the control bar stopped at the upper limit position.
Figure 6B:
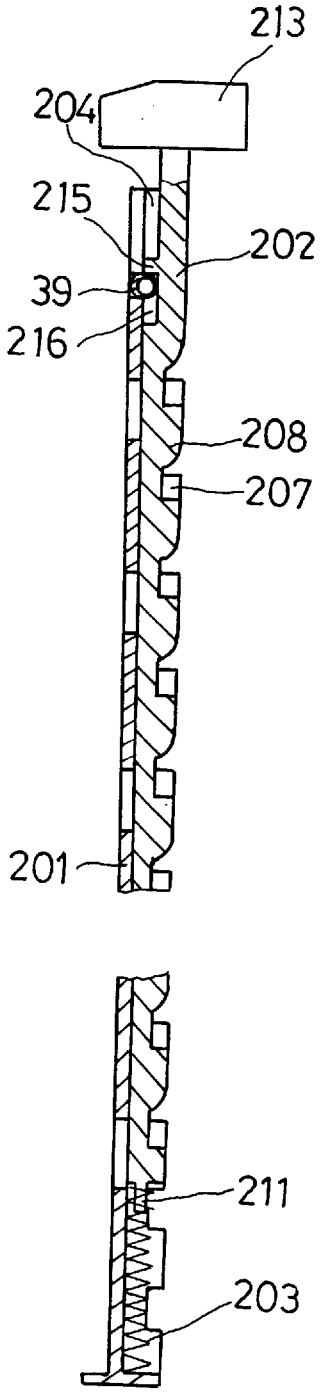
FIG. 6B is similar to FIG. 6A but showing the control bar depressed.

The right-sided bar 2 comprises an elongated outer sleeve 20, an elongated sliding track 21 and an elongated inner bar 22 that slide one inside another. The outer sleeve 20 comprises a longitudinal hole 23 through the length which receives the sliding track 21, a hook hole 24 at one side near the top, a mounting hole 26 near the bottom adapted to be fastened to one upright post 10 of the base frame 1, and a retaining hole 25 below the hook hole 24. The sliding track 21 slides in the hole 23 of the outer sleeve 20, defining a longitudinal T-groove 27 through the length. The inner bar 22 slides in the longitudinal T-groove 27 of the sliding track 21, having raised blocks 28 and transverse grooves 29 alternatively spaced at one side along the length, and a locating groove 214 transversely disposed at an opposite side near the top. When the inner bar 22 is inserted into the longitudinal T-grooves 27 of the sliding track 21, the raised blocks 28 project out of the T-groove 27. The left-sided bar 2' is comprised of an outer sleeve 20, an elongated sliding track 21, an elongated inner bar 201, a control bar 202, and a spring 203. The outer sleeve 20 and sliding track 21 of the left-sided bar 2' are identical to that of the right-sided bar 2, and therefore they are identified by like reference numbers. The inner bar 201 slides in the longitudinal T-groove 27 of the sliding track 21 of the left-sided sliding track 2', having raised blocks 207 and transverse grooves 209 alternatively spaced at one side along the length, a longitudinal groove 204 longitudinally disposed at one side across the raised blocks 207 and transverse grooves 209, a locating groove 212 transversely disposed at an opposite side near the top, and two inward projections 206 bilaterally disposed in the longitudinal groove 204 near the bottom (see FIG. 3). The control bar 202 is inserted into the longitudinal groove 204 of the inner bar 201, having raised blocks 208 and transverse grooves 210 alternatively spaced at one side along the length, two oblong coupling holes 205 bilaterally disposed near the bottom and respectively forced into engagement with the inward projections 206 of the inner bar 201 (see FIG. 3), a press block 213 transversely disposed at the top, a bottom extension rod 211 sleeved onto the spring 203, and a flange 215 disposed at an opposite side near the press block 213 and defining a longitudinal recess 216 below the flange 215. The spring 203 is mounted around the bottom extension rod 211 and supported on the headed bottom end of the inner bar 201 to impart an upward pressure to the control bar 202.

The two bars 2 and 2' are joined by a hand grip 35. The hand grip 35 comprises two pin holes 38 at two opposite ends thereof respectively fastened to a respective pin hole 217 at the sliding track 21 of each bar 2 and 2' by a respective pin 39, and a receiving chamber 37 at one of its both ends which receives the press block 213 of the control bar 202.

The top frame 3 comprises a plurality of mounting holes 32 at the top adapted for fastening to the top panel of the travel bag, two barrels 30 vertically disposed at two opposite sides and defining a respective longitudinal through hole 33 for mounting the outer sleeves 20 of the bars 2 and 2' and having a respective hooked portion 34 raised from the inside wall and projecting into the respective longitudinal through hole 33, two receiving chambers 31 bilaterally disposed between the barrels 30, two posts 4 respectively disposed in the receiving chambers 31, and two through holes 40 respectively disposed in communication between the receiving chambers 31 and the longitudinal through holes 33 of the barrels 30.

Each of the control blocks 51 comprises a beveled stop portion 57 raised from one end, a pivot pin 58 at an opposite end, and an oblong locating hole 56 spaced between the beveled stop portion 57 and the pivot pin 58.

The cover 6 is adapted to cover on the top frame 3, having a pivot pin 61 raised from the inside. A T-shaped swivel block 62 is turned about the pivot pin 61 of the cover 6, having a pivot hole 63 at the center which receives the pivot pin 61, and two pivot pins 64 at two opposite ends. Two links 65 are respectively coupled between the two opposite ends of the T-shaped swivel block 62 and the control blocks 51. Each link 65 has two pivot holes 66 at two opposite ends adapted to receive one pivot pin 64 of the T-shaped swivel block 62 and the pivot pin 58 of one control block 51.

The assembly process of the present invention is outlined hereinafter with reference to FIGS. 1, 2, 3 and 4. The inner bar 22 and sliding track 21 of the right-sided bar 2 are respectively inserted into the corresponding outer sleeve 20, permitting the raised blocks 28 of the inner bar 22 to project out of the T-groove 27 of the corresponding sliding track 21, then the spring 203 is mounted on the bottom end of the inner bar 201 of the left-sided 2', and then the inner bar 201 and sliding track 21 of the left-sided bar 2' are inserted into the corresponding sleeve 20, and then the sleeves 20 of the bars 2 and 2' are respectively mounted in the coupling holes 11 of the upright posts 10 of the base frame 1, and then the top ends of the sleeves 20 are respectively inserted through the longitudinal through holes 33 of the barrels 30 of the top frame 3 from the bottom, permitting the hook holes 24 of the sleeves 20 to be respectively forced into engagement with the hooked portions 34 and the retaining holes 25 to be respectively aligned with the through holes 40 of the top frame 3, and then the hand grip 35 is attached to the top ends of the sliding tracks 21 of the bars 2 and 2', and then the control bar 202 is inserted through the receiving chamber 37 of the hand grip 35 into the longitudinal groove 204 of the inner bar 201 of the left-sided bar 2', and then the pins 39 are respectively inserted from the pin holes 38 of the hand grip 35 through the locating grooves 214 of the inner bars 22 and 201 into the pin holes 217 of the sliding tracks 21 of the bars 2 and 2' to secure the hand grip 35 to the bars 2 and 2', permitting the left-sided pin 39 to pass through the longitudinal recess 216 of the control bar 202, and then the control blocks 51 are respectively mounted in the receiving chambers 31 of the top frame 3 by coupling the respective locating holes 56 to the respective posts 4, and then two springs 59 are respectively mounted in the top frame 3 to impart an outward pressure to the control blocks 51, causing the beveled stop portions 57 of the control blocks 51 to be forced into the through holes 40 and the retaining holes 25, and then the links 65 are respectively coupled between the T-shaped swivel block 62 and the control blocks 51, and then the T-shaped swivel block 62 is mounted on the pivot pin 61 of the cover 6, and then the cover 6 is covered on the top frame 3.

Referring to FIGS. 4, 5, 6A and 6B, when the press block 213 is not depressed, the control bar 202 is forced upwards by the spring 203 and then stopped from upward movement by the corresponding pin 39 (at this stage, the left-sided pin 39 is stopped at the bottom edge of the longitudinal recess 216 to stop the control bar 202 from upward movement), and therefore the transverse grooves 210 of the control bar 202 are respectively retained in coincidence with the transverse grooves 209 of the corresponding inner bar 201, enabling the beveled stop portions 57 of the control blocks 51 to pass through the through holes 40 of the top frame 3 and the retaining holes 25 of the sleeves 20 into engagement with the transverse grooves 29, 209 and 210 of the inner bars 22 and 201 and the control bar 202 (see FIG. 4), and therefore the retractable bars 2 and 2' are locked. When the hand grip 35 is held in hand, the press block 213 is depressed with the thumb, the flange 215 is lowered with the control bar 202 to the left-sided pin 39 (see FIG. 6B), and the raised blocks 208 of the control bar 202 are simultaneously lowered to force the beveled stop portion 57 of the left-sided control block 51 backward from the transverse grooves 209 and 210 of the corresponding inner bar 201 and the control bar 202, and at the same time the links 65 are forced to turn the right-sided control block 51 backwards from the transverse grooves 29 of the corresponding inner bar 22 (see FIG. 5), allowing the hand grip 35 to be pulled upwards or pushed downwards to adjust the bars 2 and 2'.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A retractable handle mounting structure comprising a wheeled base frame and a top frame respectively fastened to a travel bag at different elevations, said base frame comprising two upright posts defining a respective coupling hole, said top frame comprising two barrels vertically disposed at two opposite sides and two posts horizontally spaced between said barrels, each of said barrels having a longitudinal through hole and a transverse through hole at an inner side in communication with the longitudinal through hole, a cover covered on said top frame, a first outer sleeve and a second outer sleeve respectively mounted between the longitudinal through holes of the barrels of said top frame and the coupling holes of the upright posts of said base frame, each sleeve having a sliding track sliding in said sleeve, and an inner bar fastened to said sliding track and having a plurality of transverse grooves and raised blocks alternatively spaced along its length, a hand grip having a first end and a second end connected to a respective one of the sliding tracks above the barrels of said top frame by a first locating pin and a second locating pin respectively, a first control block and a second control block bilaterally and horizontally mounted in said top frame in alignment with the transverse through holes of the barrels of said top frame, two spring elements respectively mounted in said top frame to force said control blocks into the transverse through holes of the barrels of said top frame to lock said sliding tracks in position by engaging said inner bars, and a control mechanism controlled to release said control blocks from said inner bars, said control mechanism comprising a pivot pin extending from said cover on the inside, a swivel block turned about the pivot pin of said cover and having two opposite ends equally spaced from the pivot pin of said cover, two links coupled between the two opposite ends of said swivel block and said control blocks, a longitudinal groove formed in one of the inner bars at an inner side along its length, a spring mounted on a bottom end of the inner bar, and open chamber formed at the first end of said hand grip, and a control bar moved in the longitudinal groove of the inner bar and supported on the spring of said control mechanism and adapted to be depressed to release said control blocks from said inner bars, said control bar comprising a plurality of raised blocks and transverse grooves alternatively spaced at one side along its length corresponding to the raised blocks and transverse grooves of the inner bar, two oblong coupling holes bilaterally disposed near a bottom end thereof and respectively forced into engagement with respective inward projections at the inner bar, a press block transversely disposed at a top end thereof and moved in and out of a chamber in said hand grip which is in communication with one of said barrels of said hand grip for pressing by hand, and a flange disposed at an opposite side below said press block and defining a longitudinal recess below said flange, said longitudinal recess receiving said first locating pin and moved relative to it to limit up and down stroke of said control bar, the raised blocks of said control bar being lowered to force said first control block backwards when said press block is depressed, causing said first control block to disengage from the inner bar and to pull said second control block away from the other inner bar through said links, for permitting the sliding tracks to be pulled in and out of the sleeves thereof by hand through said hand grip.

* * * * *